US007377040B2

(12) United States Patent
Hornby

(10) Patent No.: US 7,377,040 B2
(45) Date of Patent: May 27, 2008

(54) METHOD OF MANUFACTURING A POLYMERIC BODIED FUEL INJECTOR

(75) Inventor: Michael J. Hornby, Williamsburg, VA (US)

(73) Assignee: Continental Automotive Systems US, Inc., Auburn Hills ( * ) Notice: Subject to any disclaimer, the term of this patent is extended or adjusted under 35 U.S.C. 154(b) by 455 days.

(21) Appl. No.: 11/015,032

(22) Filed: Dec. 20, 2004

(65) Prior Publication Data

US 2005/0132572 A1 Jun. 23, 2005

Related U.S. Application Data

(60) Provisional application No. 60/531,206, filed on Dec. 19, 2003.

(51) Int. Cl.
*B21D 53/00* (2006.01)

(52) U.S. Cl. ..... 29/890.1; 29/592.1; 29/890.12; 219/121.64; 239/88; 239/585.1; 239/585.5; 239/600

(58) Field of Classification Search ..... 29/592.1, 29/809.01, 890.1, 890.12; 219/121.64; 239/88, 585.1, 585.5, 600, 533.14, 533.2
See application file for complete search history.

(56) References Cited

U.S. PATENT DOCUMENTS 3,769,117 A 10/1973 Bowen et al.
4,951,878 A 8/1990 Casey et al.
5,150,842 A 9/1992 Hickey
5,159,915 A 11/1992 Saito et al.
5,800,399 A * 9/1998 Bogert et al. ..... 604/164.11
5,803,983 A 9/1998 Simandl et al.
5,823,445 A 10/1998 Sofer
5,893,959 A 4/1999 Muellich
5,915,626 A 6/1999 Awarzamani et al.
5,944,262 A 8/1999 Akutagawa et al.
5,971,121 A * 10/1999 Pardee ..... 192/18 B
5,996,910 A 12/1999 Takeda et al.
5,996,911 A 12/1999 Gesk et al.
6,193,833 B1 2/2001 Gizowski et al.
6,386,467 B1 5/2002 Takeda
6,464,153 B1 10/2002 Bonnah, II et al.
6,465,757 B1 10/2002 Chen
6,589,380 B2 7/2003 Gnage
6,596,122 B1 7/2003 Saviski et al.
6,631,857 B2 10/2003 Ibrahim et al.
6,782,869 B2 8/2004 Blakley
6,802,929 B2 10/2004 Ruotsalainan
6,851,631 B2 * 2/2005 Dallmeyer et al. ..... 239/585.1
2004/0031562 A1 2/2004 Kaiser et al.
2004/0031777 A1 2/2004 Bauer et al.

(Continued)

*Primary Examiner*—Paul D Kim

(57) ABSTRACT

Various methodologies relating to a polymeric fuel injector are disclosed. One method provides for manufacturing the fuel injector by forming a polymeric housing over a coil assembly and electrical connectors to provide a polymeric passage extending from an inlet to an outlet along a longitudinal axis; inserting components into the polymeric passage from at least one of the inlet and outlet; and securing a polymeric support member of a metering assembly to the housing. Another method provides for manufacturing a fuel injector housing by hermetically enclosing a polymeric housing over a coil assembly and electrical connectors to provide a continuous polymeric passage, the polymeric passage directly facing the longitudinal axis. Yet another method provides for manufacturing a metering assembly by providing a seat; and molding at least a portion of the seat to provide a polymeric support member that surrounds the outer circumference of the seat.

17 Claims, 7 Drawing Sheets

U.S. PATENT DOCUMENTS

2004/0112519 A1 6/2004 Mori
2004/0154737 A1 8/2004 Chen et al.
2004/0231788 A1 11/2004 Chen et al.

* cited by examiner

METHOD OF MANUFACTURING A POLYMERIC BODIED FUEL INJECTOR

PRIORITY

This application claims the benefits under 35 U.S.C. § 119 based on Provisional Application Ser. No. 60/531,206, entitled "Plastic Bodied Fuel Injector," and filed on Dec. 19, 2003, which application is incorporated herein in its entirety into this application.

BACKGROUND OF THE INVENTION

Examples of known fuel injection systems use an injector to dispense a quantity of fuel that is to be combusted in an internal combustion engine. The quantity of fuel that is dispensed is varied in accordance with a number of engine parameters such as engine speed, engine load, engine emissions, etc.

Known electronic fuel injection systems monitor at least one of the engine parameters and electrically operate the injector to dispense the fuel. It is believed that examples of known injectors use electro-magnetic coils, piezoelectric elements, or magnetostrictive materials to actuate a valve.

A known fuel injector utilizes a plethora of internal components such as a metallic inlet tube connected to a valve body via a non-magnetic shell with a pole piece interposed therebetween. The inlet tube, valve body, non-magnetic shell and pole piece are generally affixed to each other after a closure assembly and a metering assembly are disposed in the valve body. A solenoid coil is inserted over the assembled components and the entire assembly is molded into the fuel injector.

It is believed that one known fuel injector utilizes a plastic body molded over a solenoid coil to provide a plastic inlet fuel passage with a metallic valve body being coupled to the solenoid coil.

It is believed that another known fuel injector utilizes two separate subassemblies to form the fuel injector. The first subassembly can include a complete coil assembly (including a coil housing) and electrical connector molded into an outer casing to provide a power group. The second subassembly can include an inlet tube, pole piece, non-magnetic shell valve body, closure assembly and metering assembly affixed together to form a stand alone fuel group. The fuel group requires at least five different welding steps. They include welding an inlet tube to a pole piece; pole piece to the non-magnetic shell; the non-magnetic shell to the valve body; the coil housing to the valve body; and valve body to the seat to provide for the fuel group. The known fuel injector thus requires at least 35 manufacturing procedures that must be completed before the fuel injector is ready for calibration and testing. Thereafter, the separately formed power group and fuel group are coupled together to provide an operable fuel injector.

While the known fuel injectors are suited to the task of metering fuel, it is believed that the known fuel injectors may have certain assembly or component drawbacks that require extensive manufacturing process to be undertaken to ensure that the injector are suitable for commercial applications. They can include, for example, the necessity for multiple seal points between components to provide leak integrity in the injector and a large number of manufacturing steps that are undertaken. These seals can be effectuated by elastomeric seals, such as, O-rings, or multiple hermetic welds to ensure structural and leak integrity of the known fuel injectors. Others include the potential manufacturing difficulties associated with thermal distortion in welding multiple metallic components at close proximity to each other or the need for a metal valve body with internal resilient seals for leak integrity. Yet another drawback can include the utilization of lift setting components that must be inserted into the valve body of the fuel injector. Thus, it would be advantageous to reduce or even eliminate some of these drawbacks.

SUMMARY OF THE INVENTION

The present invention provides for, in one aspect, a fuel injector that is believed to reduce or eliminate these drawbacks of the known fuel injectors while maintaining substantially the same operative performance. The fuel injector of the present invention utilizes a minimal number of seal points and is designed so that any metal-to-metal welds that are required for the components of the fuel injector can be formed in conditions that avoid thermal distortion of the assembled fuel injector. And the fuel injector of the present invention can be manufactured with less than 35 manufacturing procedures and particularly about 25 manufacturing procedures.

According to one aspect of the present invention, a method of manufacturing a fuel injector is provided. The method can be achieved by forming a polymeric housing over a coil assembly and electrical connectors to provide a polymeric passage from an inlet proximate a first external seal to an outlet proximate a second external seal along a longitudinal axis, the polymeric passage directly facing the longitudinal axis; and securing a polymeric support member of a metering assembly directly to the polymeric housing proximate the outlet.

According to yet another aspect, a method of manufacturing a fuel injector housing is provided. The method can be achieved by hermetically enclosing a polymeric housing over a coil assembly and electrical connectors to provide a continuous polymeric passage extending from an inlet to an outlet along a longitudinal axis, the polymeric passage directly facing the longitudinal axis.

According to yet a further aspect of the present invention, a method of manufacturing a metering assembly is provided. The method can be achieved by providing a seat; and molding at least a portion of the seat to provide a polymeric support member that surrounds the outer circumference of the seat.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1:
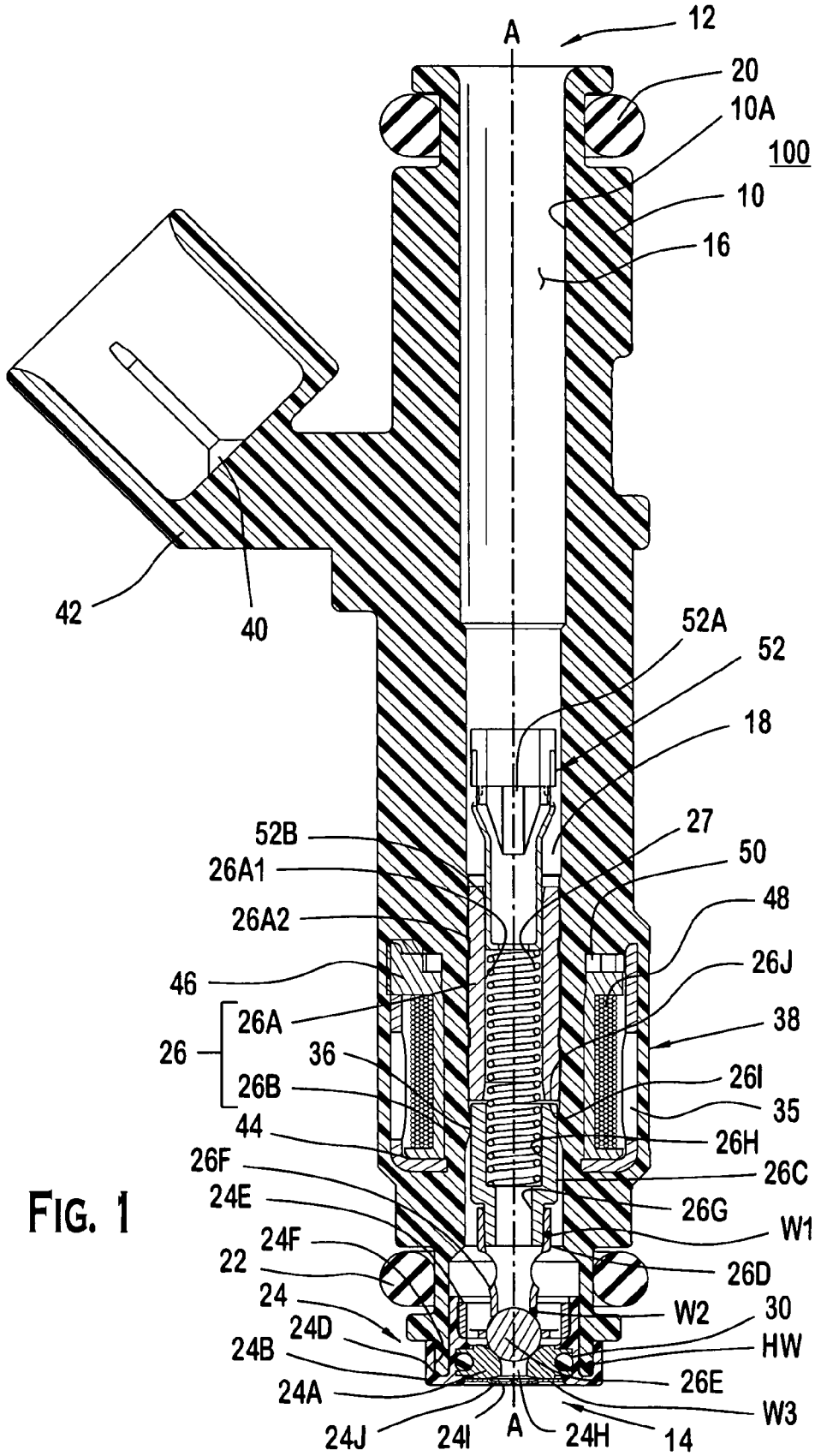
FIG. 1 is a representation of a fuel injector according a preferred embodiment.
Figure 2:
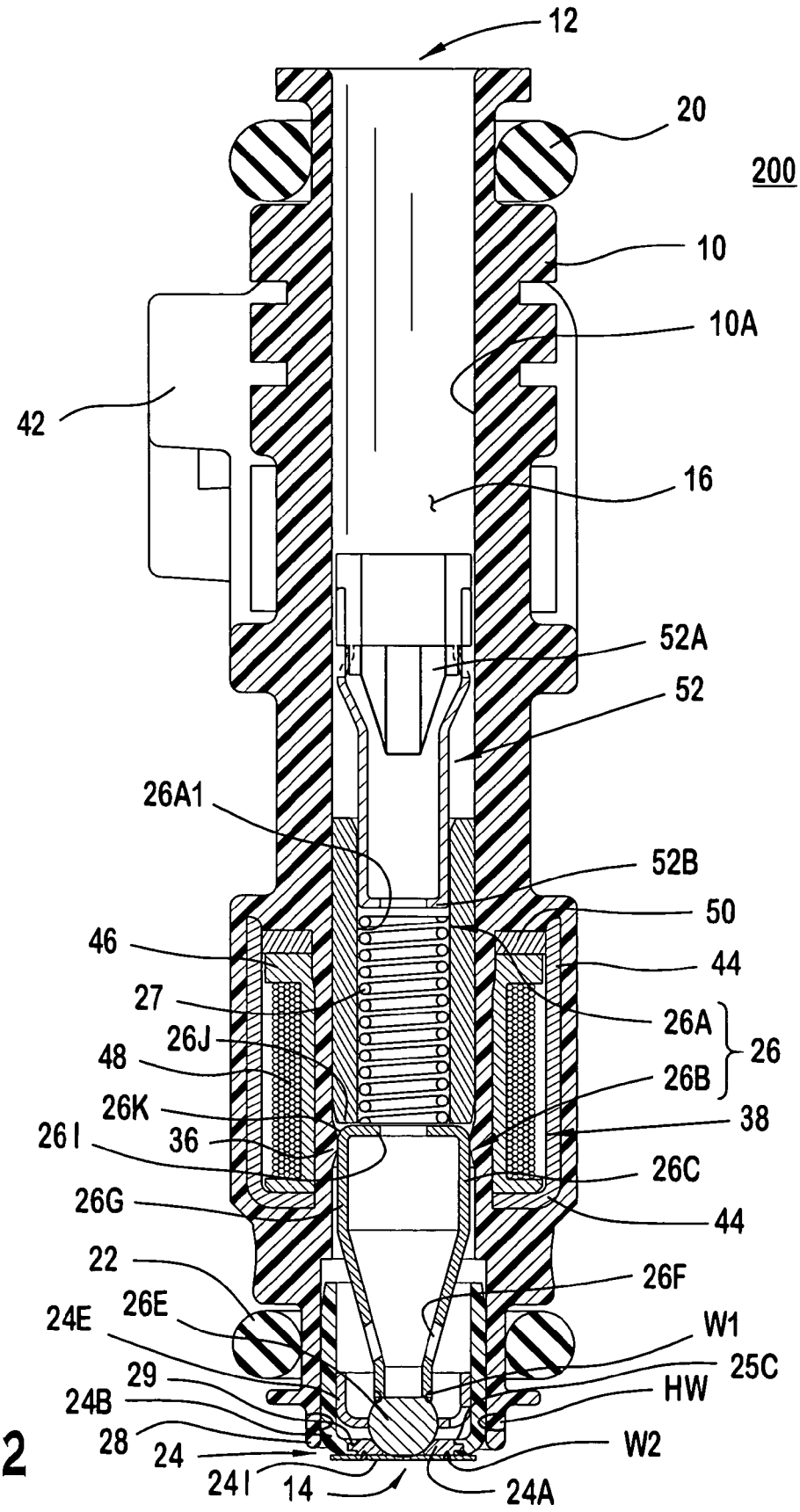
FIG. 2 is a representation of a fuel injector according to yet another preferred embodiment.

FIGS. 1-7 illustrate the preferred embodiments. Referring to FIGS. 1 and 2, the fuel injector 100 or 200 includes a continuous polymeric housing 10 extending from an inlet 12 to an outlet 14 along a longitudinal axis A-A. The polymeric housing 10 includes a polymeric wall surface 10A that directly faces the longitudinal axis A-A to define a first passage 16 in which fuel can flow from the inlet 12 to the outlet 14. The first passage 16 extends from the inlet 12 to communicate with a different internal diameter portion 18. The first passage 16 includes the polymeric bore 10A that extends from a first external seal 20 proximate the inlet 12 to a second external seal 22 proximate an outlet 14 along the longitudinal axis A-A. Disposed within a portion of the polymeric bore 10A is a metering assembly 24 proximate the second external seal 22. A closure assembly 26 is disposed proximate the metering assembly 24, which is coupled to a rim portion 28 at the outlet end 14 of the polymeric housing 10. A portion of the closure assembly 26 is disposed in the polymeric bore 10A and between the first and second external seals 20, 22. The polymeric bore 10A can also include an inward (i.e., towards the longitudinal axis A-A) surface to define a guide surface 36 for a reciprocable closure member. The inward surface preferably includes a tapered surface 36. The polymeric housing can be formed from a suitable polymeric material such as, for example, Nylon 6-6 with about 30 percent glass filler.

The polymeric housing 10 provides a complete solenoid coil subassembly that is ready for assembly with the metering and closure assemblies. In particular, the polymeric housing 10 includes a solenoid coil assembly 38 disposed within the polymeric housing 10 so that no part of the coil assembly 38 extends outside the boundary of the polymeric housing 10. The solenoid coil assembly 38 is connected to at least one electrical terminal 40 formed on an electrical connector portion 42 of the polymeric housing 10. The terminal 40 and the electrical harness connector portion 42 can engage a mating connector, e.g., part of a vehicle wiring harness (not shown), to facilitate connecting the injector 100 or 200 to an electrical power supply (not shown) for energizing the electromagnetic coil 48.

The coil assembly 38 includes a coil housing 44 disposed about the longitudinal axis A-A to surround a bobbin 46 and at least one wire coiled about the bobbin 46 to form an electromagnetic coil 48. The coil housing 44, which provides a return path for magnetic flux, generally takes the shape of a ferro-magnetic cylinder surrounding the electromagnetic coil 48. A flux washer 50 can abut a top surface of the bobbin 46 so that the flux washer 50 is in physical contact with the coil housing 44. The flux washer 50 can be integrally formed with or separately attached to the coil housing 44. The coil housing 44 can include holes, slots, or other features to break up eddy currents, which can occur when the coil 48 is de-energized.

The coil assembly 38 can be preferably constructed as follows. A plastic bobbin 46 is molded with at least one electrical contact extending from the bobbin 46 so that the peripheral edge of the contact can be mated with a contact terminal for electrical communication between the coil and a power source. A wire for the electromagnetic coil 48 is wound around the plastic bobbin 46 a predetermined number of times and connected to the at least one electrical contact portion. The electromagnetic coil 48 (with bobbin 46) is placed into the coil housing 44. The flux washer 50 is preferably placed over the bobbin 46 to contact the coil housing 44. An electrical terminal 40, which is pre-bent to a desired geometry, is then electrically connected to each electrical contact portion provided on the bobbin 46. Thereafter, the polymeric housing 10 can be formed by a suitable technique such as, for example, thermoset casting, compression molding or injection molding. The polymeric housing 10, e.g., an overmold, provides a structural casing for the injector 100 or 200 and provides predetermined electrical and thermal insulating properties. In a preferred embodiment, the polymeric housing 10 is formed by injection molding around the coil assembly 38, flux washer 50 and the electrical connector 40, i.e., an insert-molding so that the metering assembly can be affixed to the polymeric housing 10. The insert-molding hermetically seals the coil assembly 38 from contamination with fuel flowing through the polymeric fuel passage 16.

Figure 4:
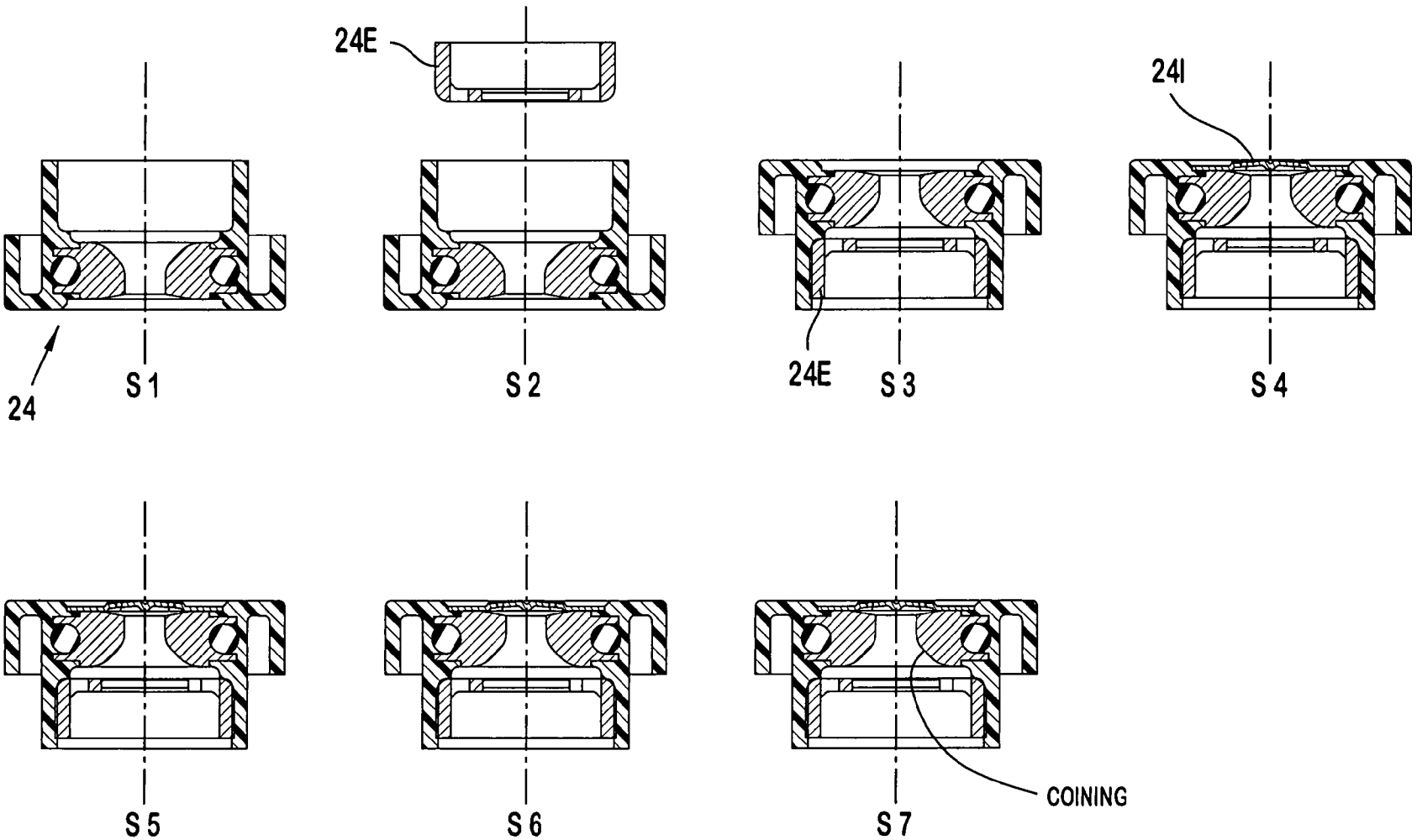
FIG. 4 illustrates a cross-sectional view of the processing steps for a metering assembly in a fuel injector of FIG. 1.

Referring to FIGS. 1 and 4, the metering assembly 24 includes a seat 24A that can be any suitable material such as, for example, plastic, ceramic or metal, long as it provides a suitably sealing surface. In the preferred embodiments, the seat 24A is formed of metallic material, and is secured to a polymeric support member 24B with a sealing member 30 (FIG. 1) or a retention member 29 and recessed portion 25C (FIG. 2). A metering disc 241 is secured to the metallic seat 24A or to the support member 24B. The support member 24B includes a first pocket 24C defined by a cylindrical portion to receive a cup-shaped guide member 24E. The cup-shaped guide member 24E can be formed from a suitable material such as, for example, polymeric, ceramic or metallic. Preferably, the guide member 24E is stamped metallic member press-fitted into the first pocket 24C (defined by cylindrical wall 23A) to a predetermined location with respect to the seat 24A via a boss extension formed in the first pocket 24C. The cup-shaped guide member 24E includes an aperture disposed about the longitudinal axis A-A and at least one aperture offset with respect to the longitudinal axis A-A. The support member 24B also includes a second pocket 24D defined by an annular cylindrical portion 23B. The second pocket 24D is configured to receive the rim portion 28 of the outlet 14 of the polymeric housing 10. Preferably, the second pocket 24D is configured so that at least a locational clearance fit to a light press-fit is formed between the rim portion 28 of the polymeric housing 10 and the inner wall surface 24F of the annular cylinder 23B and the outer surface 25A of the inner cylinder 23A of the first pocket 24C. The metallic seat 24A can be provided with the polymeric support member 24B by a suitable technique such as, for example, insert molding the metallic seat 24A with a suitable polymeric material. In the preferred embodiments, the material used for the polymeric housing 10 and bobbin 46 can be Nylon 6-6 with about 30% by weight glass filler with BASF® Ultramid A3WG6LT as the material for the polymeric support member 24B. Alternatively, the material used for the bobbin 46 and support member 24B is Nylon 6-6 with about 30% by weight glass filler with BASF® Ultramid A3WG6LT as the material for the housing 10.

The metallic seat 24A defines a seat orifice 24H generally centered on the longitudinal axis A-A and through which fuel can flow into the internal combustion engine (not shown). The seat 24A includes a sealing surface surrounding the seat orifice 24H. The sealing surface 24S, which faces the interior of polymeric bore 10A, can be frustoconical or concave in shape, and can have a finished or coated surface. A metering disc 24I can be used in connection with the seat 24A to provide at least one precisely sized and oriented metering orifice 24J in order to obtain a particular fuel spray pattern. The precisely sized and oriented metering orifice 24J can be disposed on the center axis of the metering disc 24I or, preferably, the metering orifice 24J can disposed off-axis, and oriented in any desirable angular configuration relative to one or more reference points on the fuel injector 100 or 200. Preferably, the metallic seat 24A is a stainless steel seat.

Referring to FIGS. 1 and 2, the closure assembly 26 includes a pole piece 26A and an armature assembly 26B configured to be magnetically coupled to the solenoid coil assembly 38 in a fully assembled fuel injector 100 or 200. The pole piece 26A can be formed as a cylindrical component with a passage 26A1 extending through the pole piece 26A. The pole piece 26A can be formed by a suitable technique such as cast, machined, pin rolled with external barbs or a combination of these techniques. The pole piece passage 26A1 includes a resilient member 27 disposed in the pole piece passage 26A1. The outer surface of the pole piece 26A can be provided with recesses or projections 26A2 to assist in retention of the pole piece 26A (and any flashing of the polymeric bore in the recesses) once the pole piece 26A has been press-fitted to a desired location in the polymeric bore 10A of FIGS. 1, 2, and 5.

Referring to FIGS. 1, 2, 6 and 7, a filter assembly 52 with a filter element 52A and an adjusting tube 52B is also disposed in the polymeric bore 10A. As shown in FIG. 1, the filter assembly 52 includes a first end and a second end. The filter element 52A is along a central portion of the filter assembly 52. The adjusting tube 52B is disposed in the pole piece passage 26A1. The adjusting tube 52B engages the resilient member 27 and adjusts the biasing force of the resilient member 27 with respect to the pole piece 26A. The filter element 52A is retained at an end of the filter assembly 52 spaced from the adjusting tube 52B portion and outside of the pole piece passage 26A1 so that a gap between the filter assembly 52 and the polymeric bore 10A is provided therebetween. In the preferred embodiments, the adjusting tube 52B provides a reaction member against which the resilient member 27 reacts in order to close the armature assembly 26B when the solenoid coil assembly 38 is de-energized. The position of the adjusting tube 52B can be retained with respect to the pole piece 26A or the polymeric housing 10 by an interference fit between an outer surface of the adjusting tube 52B and an inner surface of the pole piece passage 26A1. Thus, the position of the adjusting tube 52B with respect to the pole piece 26A can be used to set a predetermined dynamic characteristic of the armature assembly 26B. Thus, the position of the adjusting tube 52B with respect to the pole piece 26A can be used to set a predetermined dynamic characteristic of the armature assembly 26B.

Figure 6:
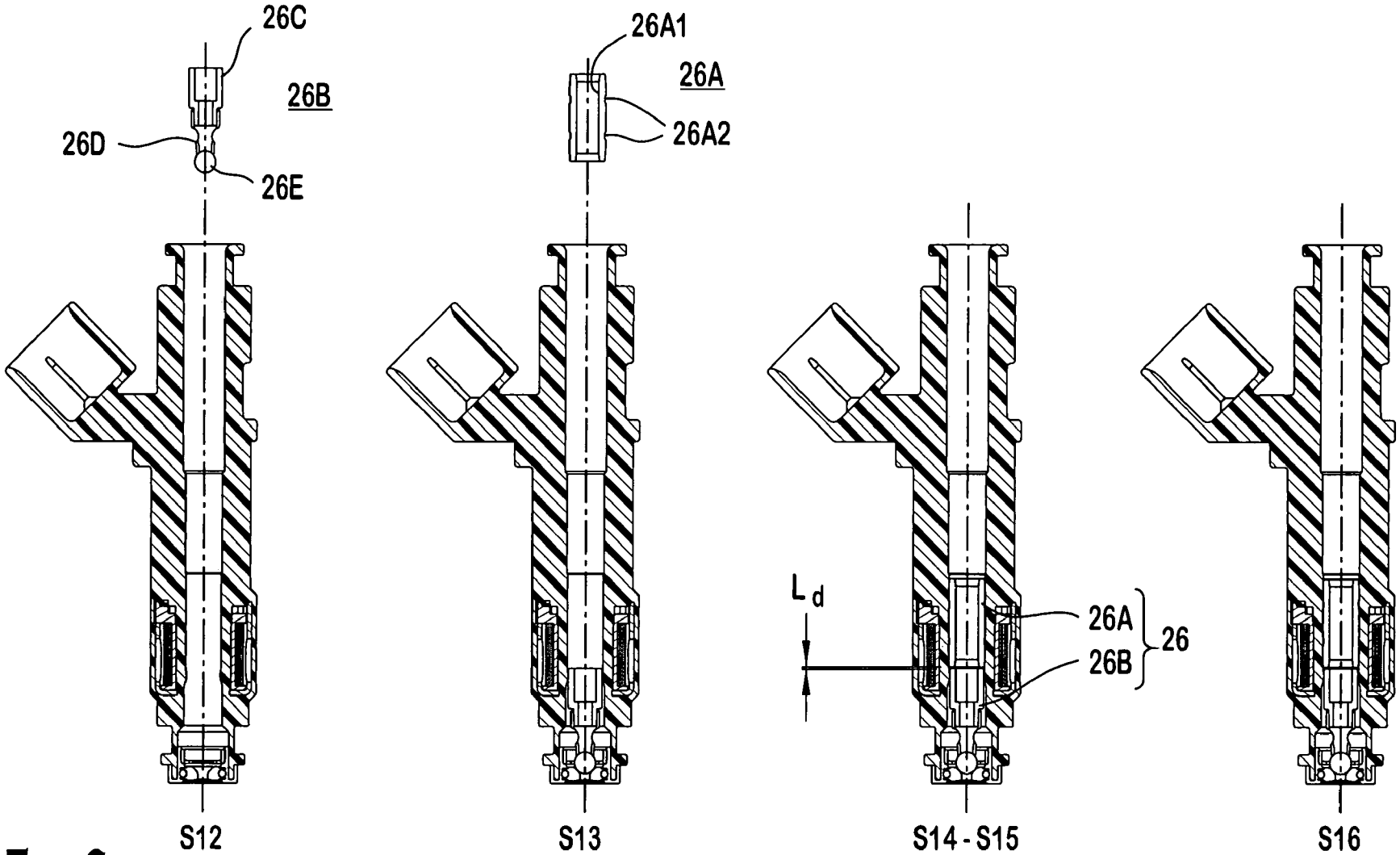

Referring to FIGS. 1 and 6, the armature assembly 26B includes an armature 26C secured to an elongated member 26D, which is secured to a closure member 26E. The closure member 26E can be of any suitable shape, such as, for example, cylindrical, semi-spherical or spherical. In the case of a spherical shaped closure member 26E, i.e., a spheroidal member, the spheroidal member can be connected to the elongated member 26D at a diameter that is less than the diameter of the spheroidal member. Such a connection would be on side of the spheroidal member that is opposite contiguous contact with the seat 24A. As noted earlier, the armature lower guide 24E can be disposed in the first pocket 24C of the polymeric support member 24B, proximate the seat 24A, and would slidingly engage the outer surface of the spherical closure member. The lower armature lower guide 24E can facilitate alignment of the armature assembly 26B along the longitudinal axis A-A, and can reduce flux leakage to the closure member 26E.

Alternatively, the armature assembly 26B can be formed by securing an armature 26C directly to the closure member 26E, as shown in FIG. 2. At least one aperture 26F can be formed through a wall of the elongated member 26D. The apertures 26F, which can be of any shape, are preferably non-circular, e.g., axially elongated, to facilitate the passage of gas bubbles. For example, in the case of a separate armature tube that is formed by rolling a sheet substantially into a tube, the apertures can be an axially extending slit defined between non-abutting edges of the rolled sheet. However, the apertures 26F, in addition to the slit, would preferably include openings extending through the sheet. The apertures 26F provide fluid communication between the armature passage 26G and the fuel inlet passage 16.

The closure member 26E is movable between a closed configuration, as shown in FIGS. 1 and 2, and an open configuration (not shown). In the closed configuration, the closure member 26E contiguously engages a seat surface of the metallic seat 24A to prevent fluid flow through the seat orifice 24H. In the open configuration, the closure member 26E is spaced from the seat surface to permit fluid flow through the seat orifice 24H.

A radial end face 26I of the armature 26C is configured to contact a radial end face 26J of the pole piece 26A when the armature 26C is moved by magnetic flux generated by the solenoid coil assembly 38. In the embodiment illustrated in FIG. 1, the armature 26C is provided with a deep counterbore 26H to receive the other end of the preload resilient element 27. In the embodiment illustrated in FIG. 2, no counterbore 26H is provided and the end of the resilient element 27 is configured to abut the radial end face 26I of the armature 26C.

The closure assembly 26 and metering assembly 24 form a valve assembly 60 that has a total number of metal-to-metal weld joints being less than five metal-to-metal weld joints and preferably three or less metal-to-metal weld joint portions W1, W2, W3 located proximate the outlet 14. The weld joint portions W1, W2, W3 can each have a continuous weld or a series of discrete welds (e.g., tack welds). A hermetic polymeric-to-polymeric bond HW can be formed between the polymeric support member 24B and the rim portion 28 of the polymeric housing 10, the weld W1 between the armature 26C and the elongated member 26D; the weld W2 between the closure member 26E and the elongated member 26D or armature 26C, and the weld W3 between the seat 24A and the metering disc 24I in the fuel injector 100. In the preferred embodiment of FIG. 2, only two metal-to-metal welds W1 and W2 are needed with a single hermetic polymeric-to-polymeric bond HW to maintain leak integrity of the fuel injector 200.

In the preferred embodiments illustrated in FIGS. 1 and 2, surface treatments can be applied to at least one of the end face of the pole piece 26A or the armature 26C to improve the armature's response, reduce wear on the impact surfaces and variations in the working air gap between the respective end faces. The surface treatments can include coating, plating or case-hardening. Coatings or platings can include, but are not limited to, hard chromium plating, nickel plating or keronite coating. Case hardening on the other hand, can include, but are not limited to, nitriding, carburizing, carbonitriding, cyaniding, heat, flame, spark or induction hardening.

The surface treatments will typically form at least one layer of wear-resistant materials on the respective end faces. These layers, however, tend to be inherently thicker wherever there is a sharp edge, such as between junction between the circumference and the radial end face of either portions. Further, this thickening effect results in uneven contact surfaces at the radially outer edge of the end portions. However, by forming the wear-resistant layers on at least one of the end faces, where at least one end portion has a surface generally oblique to longitudinal axis A-A, both end faces can be substantially in even contact with respect to each other when the solenoid coil assembly 38 is energized.

Since the surface treatments may affect the physical and magnetic properties of the ferromagnetic portion of the armature assembly 26B or the pole piece 26A, a suitable material, e.g., a mask, a coating or a protective cover, surrounds areas other than the respective end faces during the surface treatments. Upon completion of the surface treatments, the material is removed, thereby leaving the previously masked areas unaffected by the surface treatments.

In the preferred embodiment illustrated in FIG. 2, the armature 26C is formed by stamping a cylindrical workpiece of a generally constant thickness into the final configuration shown herein. As a function of the stamping process, the cylinder end portion is rolled inward so that an annular end face 26I is formed with an outer edge 26K being imbued with a radiused surface of curvature. This allows a surface coating to be formed on the radiused surface such that the coating is thicker at the junction between the radiused surface and the outer cylindrical wall surface of the armature 26C. By having a thicker coating at this junction, the contact between the end faces of the pole piece 26A and the armature 26C is believed to be in substantially even contact with each other. It should be noted that the respective thickness of the end face 26I and the sidewall of the stamped armature are generally the same. Alternatively, the armature 26C can be formed by deep drawing a generally flat workpiece through a suitable die.

Although both embodiments illustrate an armature 26C of about the same length, other lengths (e.g., shorter or longer) can be provided by implementing a different length elongated member 26D and corresponding polymeric housing 10 in the embodiment of FIG. 1 or a different length stamped armature 26C and corresponding polymeric housing 10 in the embodiment of FIG. 2.

According to the preferred embodiments, the magnetic flux generated by the electromagnetic coil 48 flows in a circuit that includes the pole piece 26A, the armature assembly 26B, the coil housing 44, and the flux washer 50. The magnetic flux moves along the coil housing 44 to the base of the coil housing 44, through the polymeric housing 10 across a radial (relative to axis A-A) or parasitic airgap to the armature 26C, and across an axial (relative to axis A-A) or working air gap towards the pole piece 26A, thereby lifting the armature 26C and closure member 26E off the seat 24A. As can further be seen in FIGS. 1 and 2, the thickness of the cross-section of the impact surface of pole piece 26A is greater than the thickness of the cross-section of the impact surface of the armature 26C. The smaller cross-sectional area allows the armature 26C to be lighter, and at the same time, causes the magnetic flux saturation point to be formed near the working air gap between the pole piece 26A and the armature 26C, rather than within the pole piece passage 26A1. Furthermore, since the armature 26C is partly within the interior of the electromagnetic coil 48, the magnetic flux is believed to be denser, leading to a more efficient electromagnetic coil 48. In the embodiment of FIG. 1, the ferromagnetic closure member 26E is magnetically decoupled from the armature 26C via the non-magnetic elongated member 26D, which reduces flux leakage of the magnetic circuit, thereby improving the efficiency of the electromagnetic coil 48.

In the preferred embodiments, the fuel injector 100 or 200 can be assembled in three discrete stages:

(I) a Fuel Group Sub-Assembly;

(II) a Fuel Group Assembly; and (III) a Final Assembly for a total of twenty-one processes.

Two other operations can be interposed between the Stages II and III: lift setting and leak testing. At the end of the Final Assembly stage, the fuel injector can be actuated for a number of predetermined cycles so that the coil 48 and other components achieve stable operational characteristics, i.e., a "run-in." After the run-in, the fuel injector 100 is calibrated to achieve a desired response time before being flow and leak tested.

Referring to FIG. 4, the Fuel Group Sub-Assembly stage can include the following procedures:

(1) Providing the metering assembly 24;

(2) Pressing the lower guide 24E into the pocket 24D;

(3) Inverting the metering assembly 24;

(4) Mounting a metering orifice disc 24I having at least one metering orifice 24J;

(5) Tack welding the metering disc 24I to the seat 24A to locate the metering disc 24I with respect to the seat;

(6) Welding the metering disc 24I to the seat 24A continuously about the longitudinal axis A-A; and (7) Coining the sealing surface 26S of the seat 24A to provide a sufficient surface finish that would form a substantially leak free seal when the closure member 26E is biased thereto.

Figure 5:
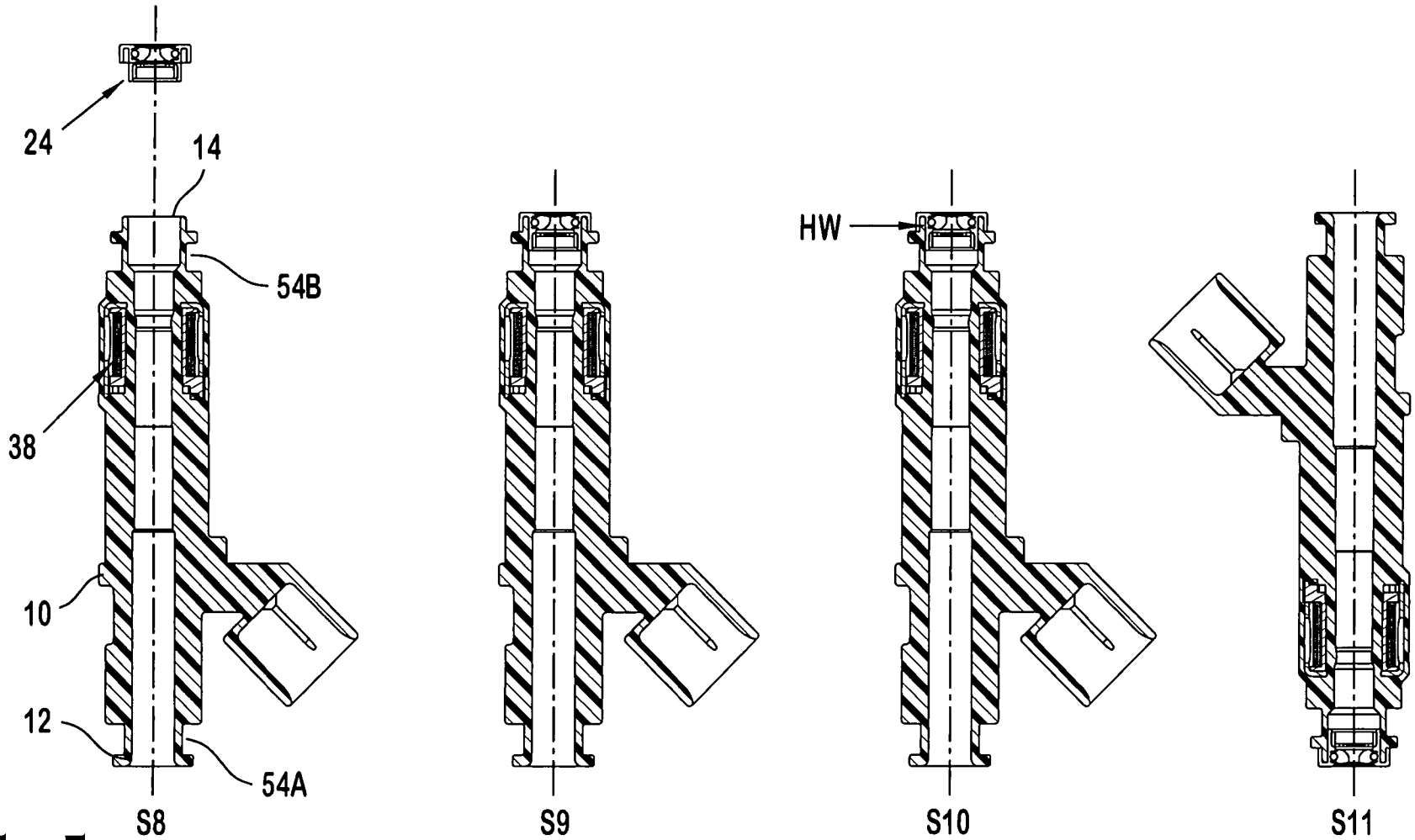
FIGS. 5-7 illustrate the processing steps for a fuel injector housing of FIG. 1.

Referring to FIGS. 5 and 6, the Fuel Group Assembly stage can include the following procedures:

(8) Providing a fuel injector housing 10 and the metering assembly 24;

(9) Installing the metering assembly 24 onto the rim 28 of the fuel injector housing 10;

(10) Securing the metering assembly 24 to the fuel injector housing 10;

(11) Inverting the fuel injector housing 10;

(12) Loading the armature assembly 26B through the inlet 12 so that the closure member 26E is contiguous to the seat 24A;

(13) Press-fitting the pole piece through the inlet 12 to preset location in the polymeric bore 10A;

(14) Measuring a lift distance Ld that the armature assembly 26B travels towards the inlet 12 when the coil 48 is energized;

(15) Adjusting the position of the pole piece 26A if the lift distance is not within tolerance, and repeating process (14) if necessary;

(16) Testing the fuel injector housing 10 with the armature assembly 26B and pole piece 26A installed in the housing 10 for leaks.

Figure 7:
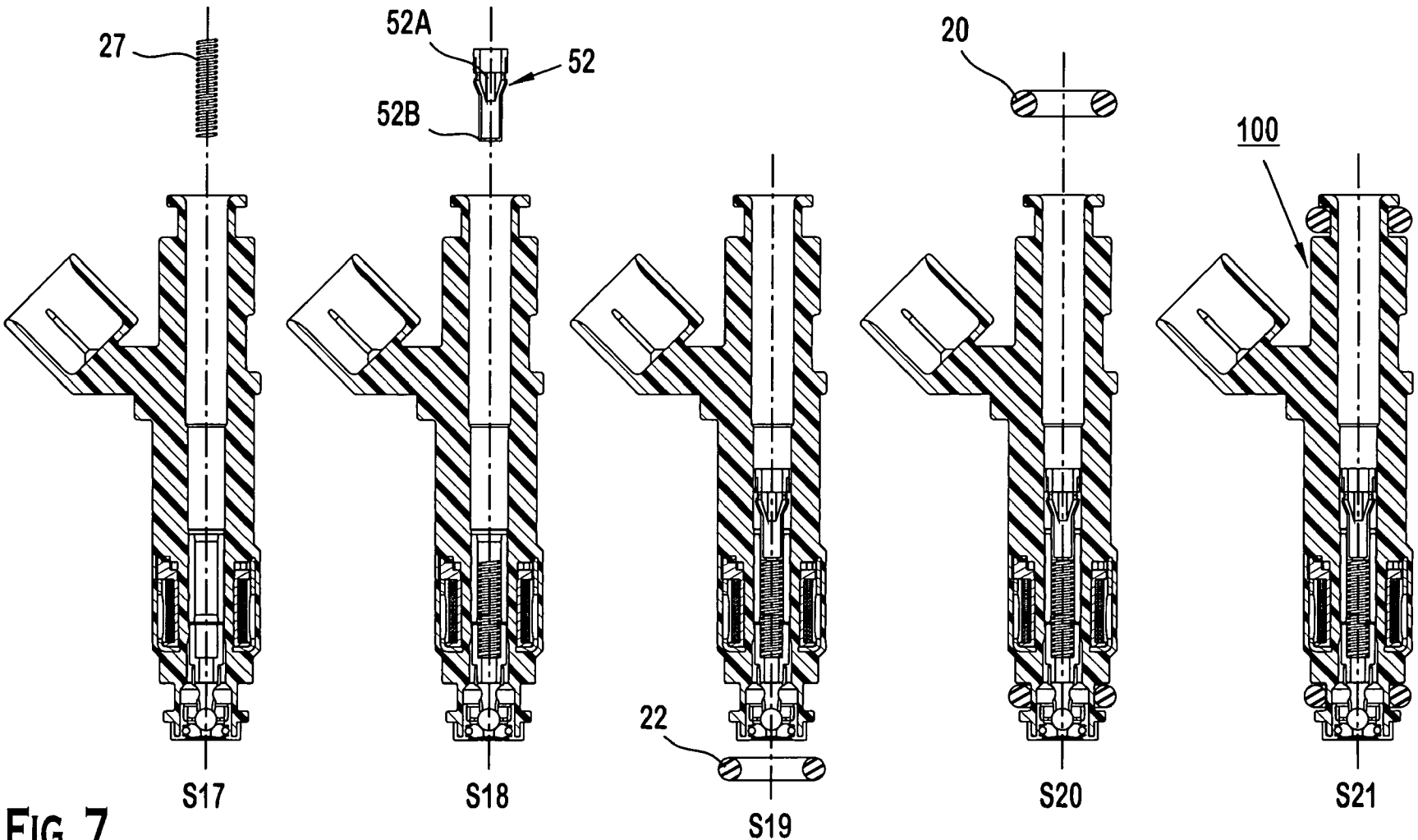

Referring to FIGS. 6 and 7, the Final Assembly stage can include the following procedures:

(17) Loading a spring element 27 through the inlet 12;

(18) Press-fitting an adjusting tube/filter assembly 52 with filter element 52A to a desired location in the through passage of the pole piece 26A. This will set a biasing spring force on the armature assembly 26B;

(19) Installing lower external seal or O-ring 22;

(20) Installing upper external seal or O-ring 20;

(21) Marking the fully assembled injector with the appropriate indicia.

Several aspects of the assembly process are discussed as follows. In stage I, the providing of the metering assembly 24, i.e., step (1), includes insert-molding a suitable seat in a mold to form the polymeric support member 24B in which the seat 24A is secured thereto. The pressing of the guide 24E, i.e., step (2), can include pressing a suitable guide such as, for example, a metallic or plastic guide into the polymeric support member 24B. The mounting of the metering disc 24I, i.e., steps (3) and (4) can be utilized with a metering disc that provides for a suitable spray geometry. Such disc can be marked and orientated in relation to the fuel injector before being secured to the seat 24A. Alternatively, the metering disc 24I can be dispensed with by utilizing a polymeric support member that completely surrounds the seat orifice 24H proximate the outlet 14 and drilling through the polymeric support member to provide for the metering orifices.

In stage II, the providing of the fuel injector 10 in step (8) can be implemented by insert-molding a coil assembly 38 with electrical connectors in an injection mold. The insert-molding forms a polymeric housing over the coil assembly 38 and connectors 40 with external seal retention pocket 54A for external seal 20 proximate the inlet 12 and external seal retention pocket 54B for external seal 22 proximate the outlet 14. The polymeric material used in the molding is preferably a nylon material generally opaque to laser wavelengths from 500-800 nanometers, such as, for example, Nylon 6-6 with 30% glass filler.

The securing of the metering assembly 24 in process step (10) can be by a suitable bonding technique such as, for example, UV light activated adhesive, thermal bonding, or laser welding to form a hermetic seal HW. Preferably, metering assembly 24 is affixed proximate the outlet 14 of the body 10 via laser plastic welding using an Nd:YAG laser. Details of the technique to form the hermetic seal HW by adhesive or laser are also disclosed in copending U.S. patent application Ser. No. 11/014,693, entitled "Method of Polymeric Bonding A Polymeric Fuel Component to Another Polymeric Fuel Component," filed on the same date as this application, which copending application is incorporated herein by reference in its entirety into this application.

The press-fitting step (13) of the pole piece 26A allows a lift distance Ld (i.e., the distance the armature assembly 26B travels to close a working air gap with the pole piece 26A) to be set. Prior to press-fitting the pole piece 26A, the end face 26J can be coated with a suitable coating. To ensure that the lift distance Ld is within tolerance, the fuel injector housing 10 can be mounted to a test jig to determine the lift distance in steps (14) and (15). Where appropriate, the position of the pole piece 26A can be adjusted to achieve a desired lift distance. Due to the potentially iterative nature of the lift set procedures, a single production line can be split into a plurality (two are shown) of parallel lift setting stations, which can thereafter be recombined back into a single production line.

Figure 3:
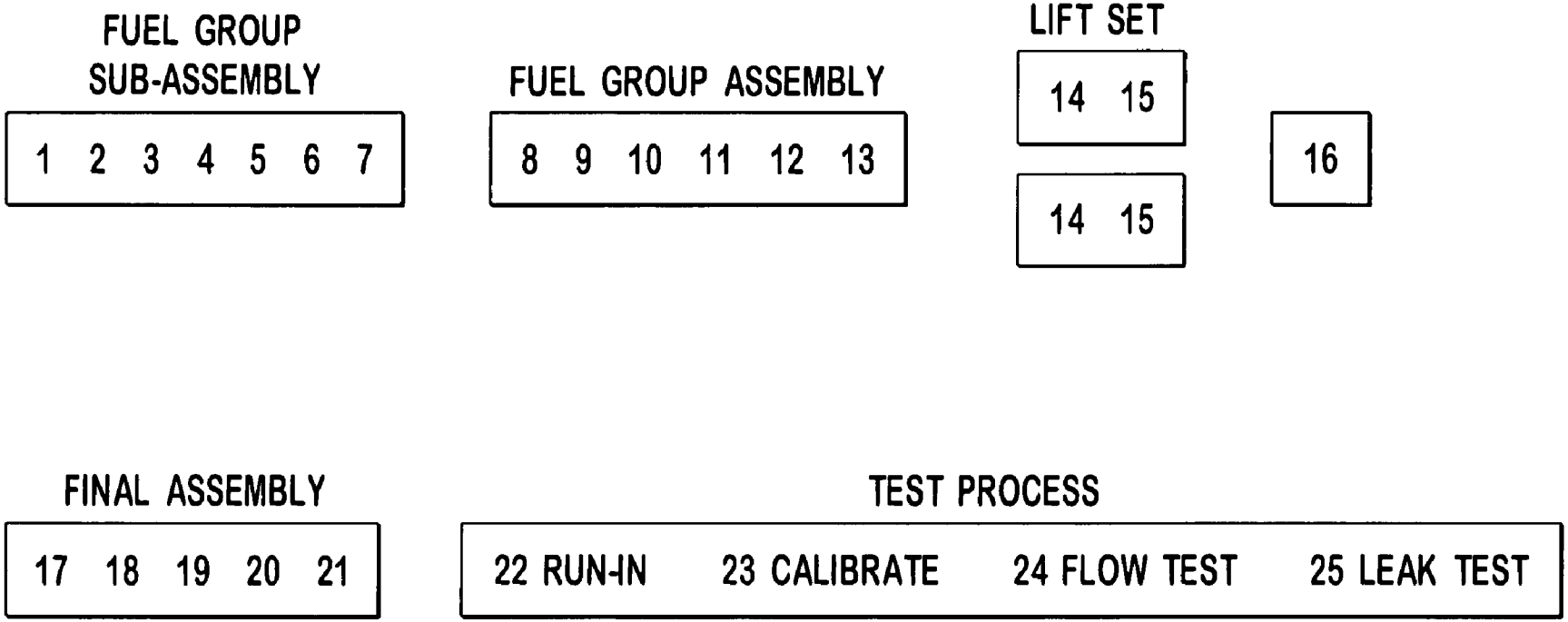
FIG. 3 illustrates an overview assembly process for the fuel injector of FIG. 1 or FIG. 2.

Referring to FIG. 3, several procedures, identified under "Test Process" are performed prior to the assembled fuel injector 100 being shipped to the end users. As noted earlier, the fuel injector 100 is run-in, calibrated, flow tested, and leak tested. In the calibration step (23), the biasing force or preload force of the resilient element 27 on the armature assembly 26B is modified by a suitable technique such as, for example, repositioning the adjusting tube/filter assembly 52 along axis A-A while flowing fuel through the fuel injector 100 or 200 to achieve a desired opening time for the closure member 26E. Alternatively, a different spring element 27 with different spring force can be used. After the calibration step (23), the fuel injector 100 or 200 is further tested (e.g., flow or leak testing) prior to being shipped to customers.

Although the assembly process has been disclosed as being performed in various discrete stages, the assembly stages are preferably sequential and can be performed in a linear layout. Alternatively, the assembly process can be performed in a non-linear layout such as, for example, a radial layout or hub and spoke arrangement.

It should be noted that the fuel injector 200 can also be manufactured using the preferred methodologies described herein. Moreover, the fuel injectors described in the following copending applications can also be manufactured using the preferred methodologies. Details of such fuel injectors are provided in: (1) "Polymeric Fuel Injector," Ser. No. 11/014,694; (2) "Method of Polymeric Bonding Fuel System Components," Ser. No. 11/014,693; (3) "Polymeric Bodied Fuel Injector With A Valve Seat And Elastomeric Seal Molded To A Polymeric Support Member" Ser. No. 11/014,692; (4) "Fuel Injector With A Metering Assembly Having A Seat Molded to A Polymeric Support Member," Ser. No. 11/014,691; (5) "Fuel Injector With A Metering Assembly Having At Least One Annular Ridge Extension Between A Valve Seat and A Polymeric Valve Body," Ser. No. 11/014,699; (6) "Fuel Injector With An Armature Assembly Having A Continuous Elongated Armature And A Metering Assembly Having A Seat And Polymeric Support Member," Ser. No. 11/014,698; (7) "Fuel Injector With A Metering Assembly Having A Seat Secured To Polymeric Support Member Having A Surface Surrounding A Polymeric Housing And A Guide Member Disposed In The Polymeric Support Member," Ser. No. 11/014,697; (8) "Fuel Injector With A Metering Assembly Having A Polymeric Support Member Which Has An External Surface Secured To A Bore Of A Polymeric Housing And A Guide Member That Is Disposed In The Polymeric Support Member," Ser. No. 11/014,696; and (9) "Fuel Injector With A Metering Assembly With A Polymeric Support Member And An Orifice Disk Positioned A Terminal End Of The Polymeric housing," Ser. No. 11/014,695, which are incorporated herein by reference in their entireties into this application.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What I claim is:

1. A method of manufacturing a fuel injector comprising:

forming a polymeric housing over a coil assembly and electrical connectors to provide a polymeric passage extending from an inlet proximate a first external seal to an outlet proximate a second external seal along a longitudinal axis, the polymeric passage directly facing the longitudinal axis;

inserting components into the polymeric passage from at least one of the inlet and outlet; and securing a polymeric support member of a metering assembly directly to the polymeric housing proximate the outlet.

2. The method of claim 1, wherein the forming comprises insert molding the coil assembly and electrical connectors, the coil assembly including a bobbin and multiple wire windings surrounded by a coil housing contiguous to a flux washer disposed generally orthogonal to the longitudinal axis.

3. The method of claim 2, wherein the insert molding comprises providing an external seal retention pocket proximate the inlet and outlet.

4. The method of claim 3, wherein the insert molding comprises providing a polymeric passage having at least two different diameters, each spaced apart from the other along the longitudinal axis.

5. The method of claim 4, wherein the insert molding comprises hermetically sealing the coil assembly from the polymeric passage.

6. The method of claim 5, wherein the insert molding comprises providing a nylon material generally opaque to radiant energy.

7. The method of claim 1, wherein the inserting comprises inserting a closure assembly, pole piece, resilient bias member and filter assembly through the inlet.

8. The method of claim 7, wherein the securing comprises insert molding a seat to form the metering assembly having the seat secured to the polymeric support member.

9. The method of claim 8, wherein the securing comprises inserting a guide member in the metering assembly, the guide member having a central aperture to guide the closure member along the longitudinal axis and at least one aperture offset to the longitudinal axis.

10. The method of claim 9, wherein the securing comprises securing a metering disc to the seat.

11. The method of claim 10, wherein the securing comprises bonding the polymeric support member to the polymeric housing proximate the outlet.

12. The method of claim 10, wherein the securing comprises laser welding the polymeric support member to the polymeric housing proximate the outlet.

13. The method of claim 1, wherein the inserting of components comprises:

connecting an armature to a closure member to provide an armature assembly;

coating an end face of a pole piece having at least one continuous recessed surface formed on the outer circumference of the pole piece; and inserting the armature assembly and pole piece into the polymeric passage from the inlet to a position proximate the outlet;

inserting a biasing spring and adjusting tube assembly into the polymeric passage, the adjusting tube assembly having a filter element coupled to an adjusting tube.

14. A method of manufacturing a fuel injector comprising:

forming a polymeric housing over a coil assembly and electrical connectors to provide a polymeric passage extending from an inlet proximate a first external seal to an outlet proximate a second external seal along a longitudinal axis, the polymeric passage directly facing the longitudinal axis;

inserting components into the polymeric passage from at least one of the inlet and outlet; and securing a polymeric support member of a metering assembly directly to the polymeric housing proximate the outlet;

wherein the inserting of components comprises;

connecting an armature to a closure member to provide an armature assembly;

coating an end face of a pole piece having at least one continuous recessed surface formed on the outer circumference of the pole piece;

inserting the armature assembly and pole piece into the polymeric passage from the inlet to a position proximate the outlet; and inserting a biasing spring and adjusting tube assembly into the polymeric passage, the adjusting tube assembly having a filter element coupled to an adjusting tube; and wherein the securing comprises:

providing a metering assembly having a seat secured to a polymeric support member, the polymeric support member having at least a retention portion generally transparent to laser light;

inserting an armature guide member into the metering assembly;

inverting the metering assembly;

orientating a metering disc with respect to the seat;

securing the metering disc to the seat; and coining a surface of the seat to provide a sealing surface for a closure member.

15. The method of claim 14, wherein the securing comprises:

coupling the retention portion of the metering assembly to the polymeric housing; and laser welding the retention portion to the polymeric housing.

16. The method of claim 15, further comprising:

calibrating the fuel injector to achieve a desired response time as measured from when the coil is energized to when the closure member is contiguous to the pole piece.

17. The method of claim 16, wherein the calibrating comprises adjusting a position of the adjusting tube assembly with respect to the armature assembly.

* * * * *